US007011533B2

(12) United States Patent
Miyamoto

(10) Patent No.: US 7,011,533 B2
(45) Date of Patent: Mar. 14, 2006

(54) CARD CONNECTOR

(75) Inventor: Osamu Miyamoto, Tokyo (JP)

(73) Assignee: Hirose Electric C., Ltd., Tokyo (JP)

( * ) Notice: Subject to any disclaimer, the term of this patent is extended or adjusted under 35 U.S.C. 154(b) by 0 days.

(21) Appl. No.: 10/969,356

(22) Filed: Oct. 21, 2004

(65) Prior Publication Data

US 2005/0095917 A1 May 5, 2005

(30) Foreign Application Priority Data

Oct. 29, 2003 (JP) ..... 2003-368397

(51) Int. Cl.
*H01R 4/66* (2006.01)

(52) U.S. Cl. ..... 439/95; 439/108; 439/607

(58) Field of Classification Search ..... 439/95, 439/92, 108, 607–610, 630
See application file for complete search history.

(56) References Cited

U.S. PATENT DOCUMENTS 5,890,917 A * 4/1999 Ishida et al. ..... 439/101
6,074,223 A * 6/2000 Huang ..... 439/95
6,227,880 B1 * 5/2001 Zhu et al. ..... 439/92
6,379,163 B1 * 4/2002 Yu ..... 439/95
6,544,071 B1 * 4/2003 Wu ..... 439/607
6,692,294 B1 * 2/2004 Kobayashi ..... 439/496
6,739,884 B1 * 5/2004 Vicich et al. ..... 439/108
6,773,275 B1 * 8/2004 Chen ..... 439/92
6,793,508 B1 * 9/2004 Chang ..... 439/95

FOREIGN PATENT DOCUMENTS

JP 2003-59557 2/2003

* cited by examiner

*Primary Examiner*—Gary Paumen
(74) *Attorney, Agent, or Firm*—Takeuchi & Kubotera, LLP

(57) ABSTRACT

A card connector includes an insulating housing having signal and ground terminals and a metal cover for covering the insulating housing. The flexible section of the ground terminal is disposed in the vertically upper region of the ground contact section of the card inserted in the card housing space. The metal cover is provided with a ground tongue disposed in the vertically upper region so that when the card is inserted in the card housing space, the flexible section of the ground terminal comes into contact with the ground contact section of the card.

14 Claims, 4 Drawing Sheets

CARD CONNECTOR

BACKGROUND OF THE INVENTION

1. Field of the Invention

The present invention relates to card connectors and, particularly, to a card connector with a metal cover used as a ground.

2. Description of the Related Art

JP 2003-59557 discloses a card connector which includes an insulating housing having signal and ground terminals and a metal cover for covering the insulating housing. It has a card housing space for receiving an IC card that has signal and ground contact sections on its surface. When the IC card is inserted into the card housing space, the signal and ground contact sections are brought into contact with the signal and ground terminals of the insulating housing.

The ground terminal is grounded through only a substrate circuit, resulting in the poor ground connection. As a result, the ground contact section of the IC card has a high impedance, causing noises.

SUMMARY OF THE INVENTION

Accordingly, it is an object of the invention to provide a card connector having the improved ground connection between the ground contact section of the card and the card connector.

According to the invention there is provided a card connector which comprises an insulating housing; at least one signal terminal provided in the insulating housing; at least one ground terminal provided in the insulating housing; a metal cover for covering the insulating housing to form a card housing space for receiving a flat card having at least one signal contact section and at least one ground contact section on at least one surface thereof such that when the flat card is inserted into the card housing space, the signal and ground contact sections are brought into contact with the signal and ground terminals. The ground terminal has a flexible section disposed in a vertically upper region of the ground contact section when the flat card is in the card housing space. The metal cover has a ground tongue overlapping the flexible section in the vertically upper region so that when the flat card is inserted into the card housing space, the ground contact section of the flat card comes into contact with and flexes the flexible section of the ground terminal, thus bringing it into contact with the ground tongue of the metal cover or increasing a contact pressure between the flexible section and the ground tongue.

According to another aspect of the invention there is provided a card connector which comprises an insulating housing; at least one signal terminal provided in the insulating housing; at least one ground terminal provided in the insulating housing; a metal cover for covering the insulating housing to form a card housing space for receiving a flat card having at least one signal contact section and at least one ground contact section on at least one surface thereof such that when the flat card is inserted into the card housing space, the signal and ground contact sections are brought into contact with the signal and ground terminals. The ground terminal has a flexible section disposed in a vertically upper region of the ground contact section when the flat card is in the card housing space. The metal cover has a ground tongue overlapping the flexible section in the vertically upper region so that when the flat card is inserted into the card housing space, the flexible section of the ground terminal is brought into contact with the ground contact section of the flat card on a side and the ground tongue of the metal cover on the other side.

In the card connector, the metal cover may be connected to a ground and the flexible section of the ground terminal may be flexible in the vertically upper region. The ground tongue may extend forwardly into the vertically upper region. The flexible section of the ground terminal may extend in a direction opposite to a direction in which the ground tongue extends. The card connector further comprises a card regulation member extending into the card housing space in the vertically upper region.

According to the invention, when the card is inserted into the card connector, the ground contact section of the card comes into contact with the metal cover to provide an efficient ground connection, thereby reducing the impedance of the card and suppressing noise generation.

DESCRIPTION OF THE PREFERRED EMBODIMENTS

1. Structure

Figure 1:
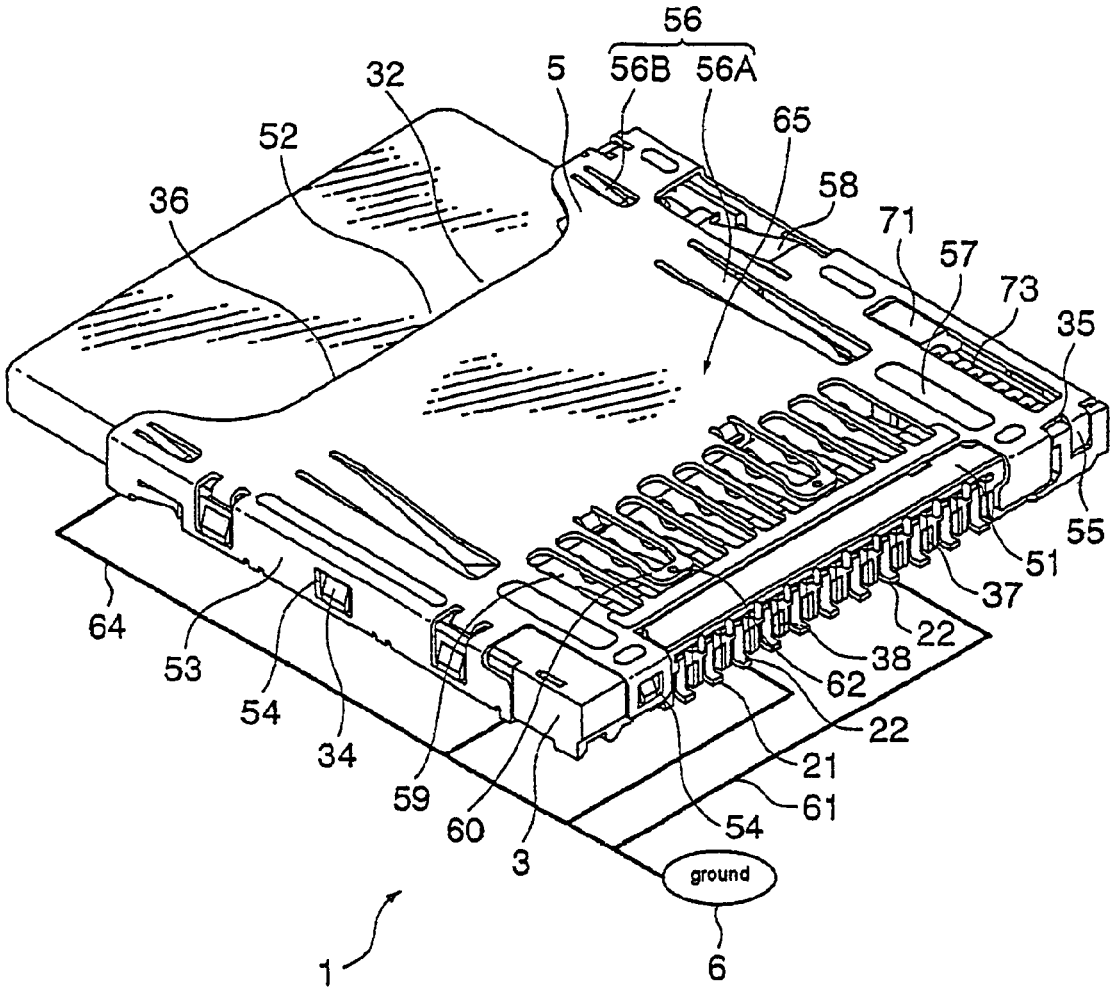
FIG. 1 is a perspective view of a card connector according to an embodiment of the invention.
Figure 2:
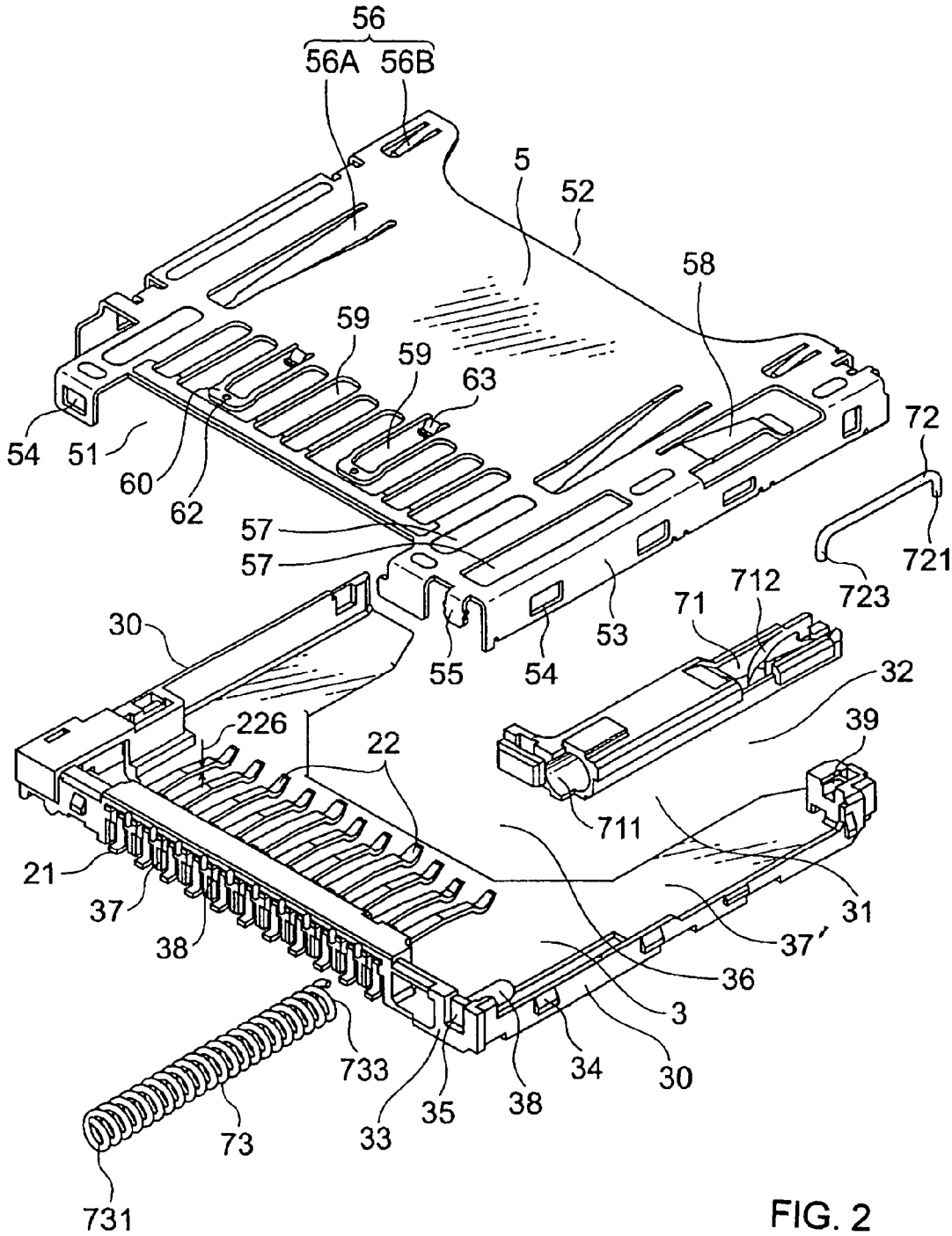
FIG. 2 is an exploded perspective view of the card connector.
Figure 3:
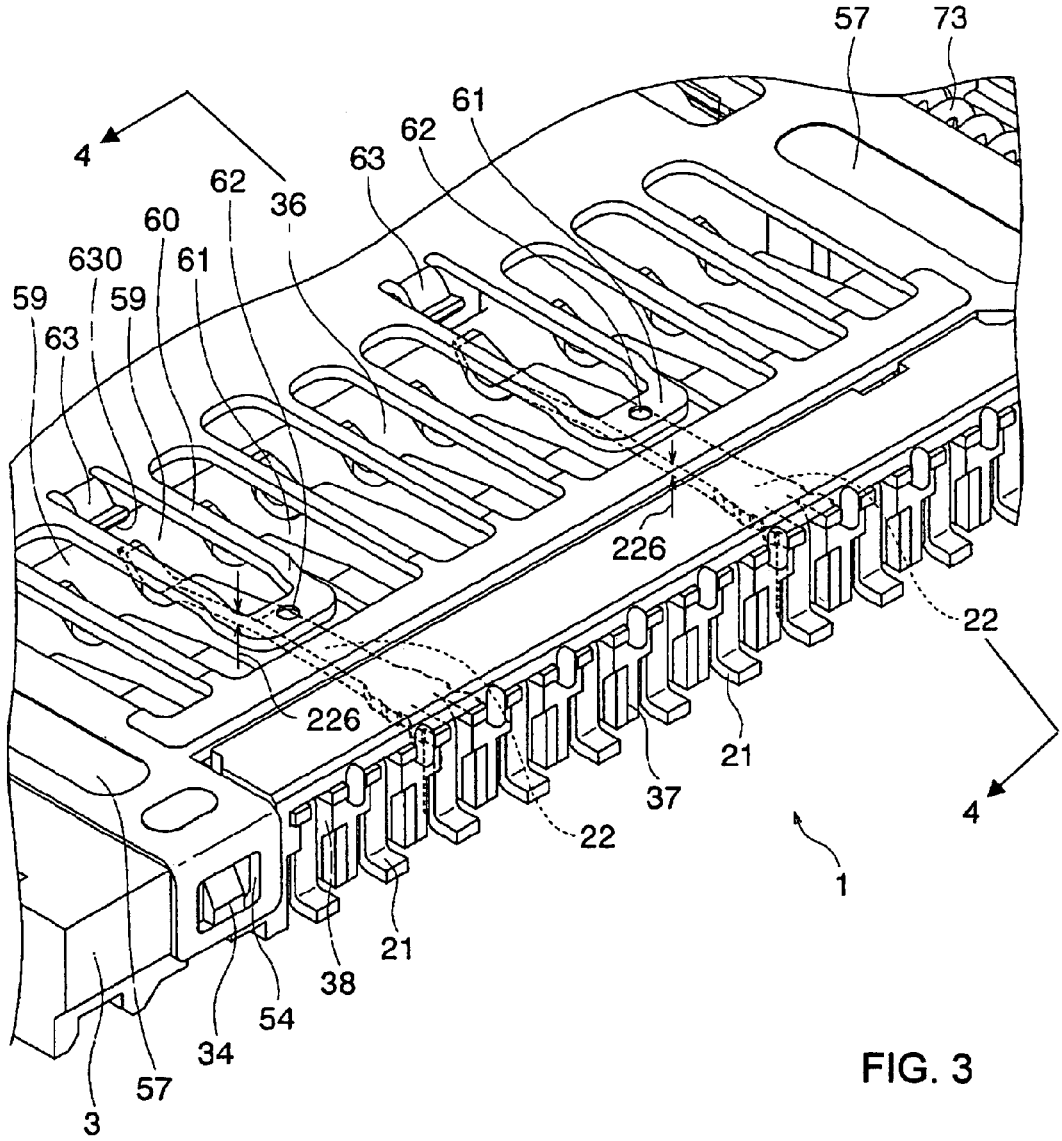
FIG. 3 is an enlarged perspective view of the rear portion of the card connector.

FIGS. 1–3 show a card connector according to an embodiment of the invention. A card connector 1 includes an insulating housing 3, contact terminals 21 and 22, a metal cover 5, and a card insertion/ejection control member or ejector 71, a pin 72, and a coil spring 73. An example of the useful card is a flat IC card having a plurality of signal contact sections for signal transmission and a plurality of ground contact sections 91 (FIG. 5) for ground connection. In this embodiment, it has nine (9) signal contact sections and two (2) ground contact sections.

1-1. Insulating Housing

The insulating housing 3 is made by resin molding so as to provide openings in the top face 31 and the rear side 32. The open top face 31 is covered by the metal cover 5. In order to secure the metal cover 5 to the insulating housing 3, there are provided tapered projections 34 and hook recesses 35 on the side walls 30 and the side rear wall 33, respectively. The metal cover 5 is secured to the insulating housing 3 to form a card housing space 36. The IC card is inserted into the card housing space 36 through the rear side 32.

A plurality of terminal arranging sections 38 are provided in the rear wall 37 of the insulating housing 3. The contact terminals 21 and 22 are arranged in the terminal arranging sections 38 in a direction in which the IC card is inserted into the card housing space 36. Nine (9) signal terminals 21 and two (2) ground terminals 22 are provided corresponding to the IC card. These terminals 21 and 22 are made vertically flexible in the direction of the thickness of the terminals (226) so that when the IC card is inserted into the card housing space 36, they are brought into elastic contact with the signal and ground contacts 91 of the IC card.

An assembling space 37' is provided on the left side of the insulating housing 3 as viewed from the front side 32 to house the ejector 71, the pin 72, and the coil spring 73. A positioning column 38 extends into the assembling space 37' from the rear wall 37 for the coil spring 73. A semi-circular hook section 39 is provided in the front portion of the assembling space 37' for rotatably positioning an end 721 of the pin 72 within a predetermined angular range. An end 731 of the coil spring 73 is attached to the positioning column 38 while the other end 733 of the coil spring 73 is inserted into an insertion hole 711 provided in a rear end of the ejector 71, and the front end 721 of the pin 72 is placed in the hook section 39 while the rear end 723 of the pin 72 is slidably positioned in a heart-shaped sliding section 712 provided in the front end of the ejector 71 to form a push-type ejector mechanism for the IC card. This type of ejector is well known in the art and no more description will be made.

1-2. Metal Cover

The metal cover 5 is made by stamping and bending a sheet of stainless steel. The process is relatively easy. The metal cover 5 covers the insulating housing 3 for protection against impact and shielding. According to the invention, it also serves as ground connection for the IC card and it is preferred that it is connected to the ground 6 like the ground terminal 22. This connection is made through a substrate circuit 64 similar to a substrate circuit 61 for the ground terminals 22.

The central portion of a rear side 51 of the metal cover 5 is opened for expose the contact terminals 21 and 22. Similarly, the front side 52 is opened for insertion of the IC card. The left and right side walls 53 are substantially closed. These sides 51–53 have fixing holes 54 and fixing projections 55 corresponding to the tapered projections 34 and rectangular recesses 35 in the insulating housing 3 for securing the metal cover 5 to the insulating housing 3.

Two sets of long and short card holding fingers 56A and 56B are provided in the metal cover 5 for holding the card inserted in the card housing space 36. The card holding sections 56A and 56B press down the card against the bottom of the card housing space 36 for preventing the IC card from coming out of the holding space 36.

An access opening 57 is provided in the top face of the metal cover 5 for facilitating access to the coil spring 73 assembled in the insulating housing 3. A pin holding tongue 58 is provided in the metal cover 5 for pressing down the pin 72 disposed in the assembling space 37'.

A plurality of escape openings 59 are provided in the top face of the metal cover 5 one for each of the contact terminals 21 and 22. When the IC card is inserted into the card housing space 36, the signal and ground terminals 21 and 22 are flexed upwardly, with their tips 221 escaping through the openings 59.

1-3. Ground Tongues

Tow ground tongues 60 are provided in the metal cover 5. The escape opening 59 is provided in each of the ground tongues 60 to form a substantially rectangular ring shape. The ground tongue 60 extends rearwardly (insertion direction of the IC card) in a region above the ground terminal 22 and a ground contact 91 of the IC card (hereinafter "vertically upper region"). The ground tongues 60 are made vertically flexible in the vertically upper region.

The ground tongues 60 are exposed to the card housing space 36 so that they are able to come to direct contact with the ground terminals 22 to connect the IC card to the ground 6. The ground tongues 60 have a stepped down rear portion 61. A downward spherical projection 62 is made by rolling on the rear end portion 61. The ground tongues 60 are normally or at least when the IC card is inserted in the card housing space 36 in direct contact with the ground terminals 22 via the spherical projections 62.

1-4. Card Regulation Member

A card regulation member 63 is provided at the root of each ground tongue 60 so as to project into the card housing space 36 through the escape opening 59 such that the downwardly extending end portion 630 is disposed in the vertically upper region. The card regulation member 63 is disposed in the ground tongue 60 so that it comes into contact with only the ground contact of the IC card. In other words, it is not in contact with the signal contact at all. If the card regulation member 63 comes into contact with the signal contact, a short-circuit can take place.

The card regulation members 63 have two main functions. First, it restricts the range of upward movement of the IC card upon insertion into the card connector, thereby preventing over-deformation of the contact terminals 21 and 22 and the ground tongues 60. Secondly, it assures connection between the IC card and the ground terminals 22 (and the signal terminals 21).

1-5. Ground Terminals

As described above, there are two types of contact terminals; i.e., the signal terminal 21 and the ground terminal 22. Their structures are substantially the same but their functions are different, and the ground terminal 22 will be described below.

The ground terminal 22 has a fixing section 221, a mounting section 224, and a flexible section 225. The fixing section 221 is soldered to a substrate and connected to the ground 6 via the substrate circuit 61. The mounting section 224 extends upwardly from the fixing section 221 and is mounted in a vertical arranging groove provided in the insulating housing 3. The flexible section 225 extends laterally from the mounting section 224 and the base portion is press fitted and fixed to the terminal arranging section 38.

The flexible section 225 extends forwardly from the mounting section 224 and is vertically flexible. The flexible sections 225 extend in the opposite direction to the ground tongues 60, but the free ends of the flexible sections 225 can escape through the escape openings 59 of the ground tongues 60 so that the flexible sections 225 do not interfere with the ground tongues 60, with the result that the flexible sections 225 can be made sufficiently long to provide a satisfactory spring property.

The flexible section 225 has a curved terminal contact 222 which comes into mechanical and electrical contact with the ground contact section 91 of the IC card when the IC card is inserted into the card connector. The distance (A) between the bottom 40 of the card housing space 36 and the terminal contact 222 is made smaller than the distance (B) between the bottom 40 and the end portion 630 so that the ground terminal 22 comes into contact with the ground contact section 91 before the regulation member 63 comes into contact with the ground contact section 91 of the IC card.

The middle portion 223 of the flexible section 225 is made slightly convex so as to come to contact with the spherical projection 62 of the ground tongue 60. The contact pressure is increased when the IC card is inserted into the card connector to flex the ground terminals 22 upwardly. Weather the flexible section 225 is in contact with the ground tongue 60 prior to insertion of the IC card is not critical but the firm (direct) contact after the insertion is essential. That is, if the flexible section 225 is in contact with the ground tongue 60 prior to the IC card insertion, the contact pressure is increased after the IC card insertion. On the other hand, if they are not in contact with each other prior to the IC card insertion, the flexible section 225 is brought into firm contact with the ground tongue 60 after the IC card insertion. The contact pressure prior to the IC card insertion should be relatively low because if the contact pressure is high, the flexible section 225 is deformed by the ground tongue 60 under the reflow heat during the connector production.

2. Operation

Figure 4:
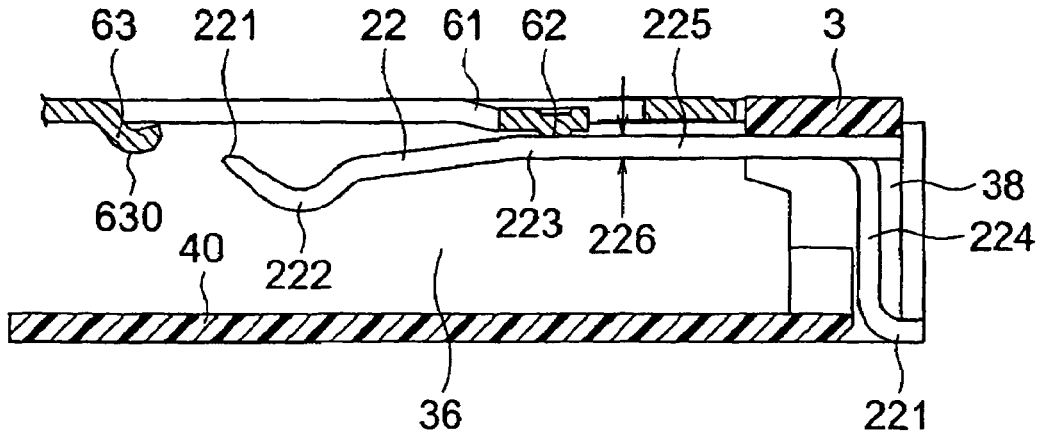
FIG. 4 is a sectional view taken along line 4—4 of FIG. 3.
Figure 5:
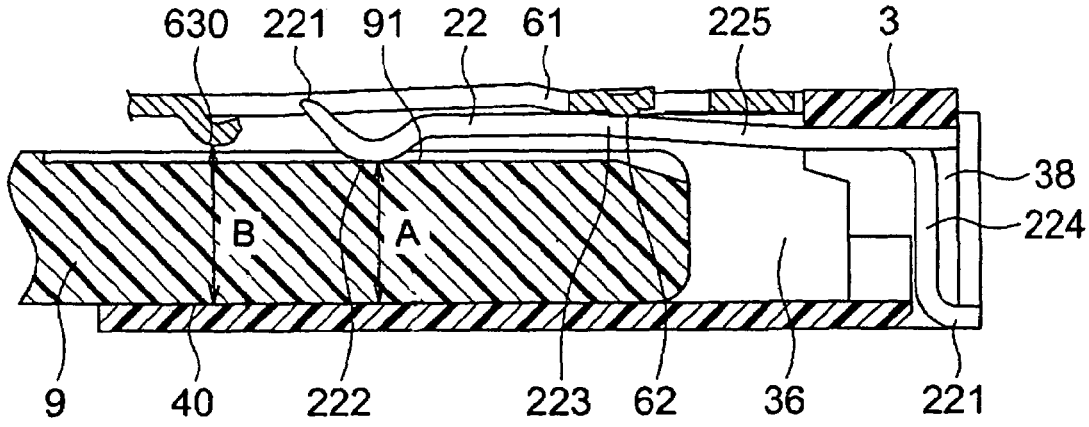
FIG. 5 is a sectional view taken along line 4—4 of FIG. 3, wherein an IC card is being inserted into the card housing space.

In FIG. 4 is a sectional view taken along line 4—4 of FIG. 3. In FIG. 5, the IC card is being inserted into the card housing space 36. The ground (or signal) contact section 91 is indented in the IC card.

When the IC card is inserted into the card housing space 36, the ground contact section 91 comes into contact with the terminal contact 222 of the flexible section 225 to flex the flexible section 225 upwardly so that the middle portion 223 increases the contact pressure or comes into contact with the spherical projection 62 of the ground tongue 60. Consequently, the ground contact section 91 is electrically connected to the metal cover 5 via the ground terminal 22 and thus to the ground via the metal cover 5. A part of the contact terminals 22 is used as ground terminal so that the ground terminal is brought into stable contact with the contact section 91 of the IC card without interference with the insertion/ejection of the IC card.

The ground terminal 22 has been connected to the ground 6 via only the substrate circuit 61 (FIG. 1) that is a relatively narrow path but, according to the invention, it is connected to both the substrate circuit 61 and the metal cover 5 having an area 65 much larger than the substrate circuit 61, thereby providing better grounding effects. The ground terminal 22 makes direct contact with the metal cover 5 to provide better grounding effects. The metal cover 5 is connected to the ground 6 via the substrate circuit 64, too, thus providing grounding effects better than the grounding wherein the ground terminal 22 is connected directly to only the substrate circuit 61. In this way, the direct contact between the ground terminal 22 and the metal cover 5 reduces the impedance of the ground contact section 91 of the IC card. In addition, the ground contact section 91 is covered by the ground terminal 22 and the ground tongue 60 in the vertically upper region, thereby suppressing noise generation.

3. Miscellaneous

Alternatively, the ground tongue 60 may be provided so as to extend forwardly (card ejection direction). The metal cover 5 can provide grounding effects even if it is not grounded. The IC card may have a ground contact section or sections on the back side or both the back and top sides. The invention is useful for card connectors with a metal cover.

What is claimed is:

1. A card connector, comprising:

an insulating housing;

at least one signal terminal provided in said insulating housing;

at least one ground terminal provided in said insulating housing;

a metal cover for covering said insulating housing to form a card housing space for receiving a flat card having at least one signal contact section and at least one ground contact section on at least one surface thereof such that when said flat card is inserted into said card housing space, said signal and ground contact sections are brought into contact with said signal and ground terminals;

said ground terminal having a flexible section disposed in a vertically upper region of said ground contact section when said flat card is in said card housing space;

said metal cover having a ground tongue overlapping said flexible section in said vertically upper region so that when said flat card is inserted into said card housing space, said ground contact section of said flat card comes into contact with and flexes said flexible section of said ground terminal, thus increasing a contact pressure between said flexible section of said ground terminal and said ground tongue of said metal cover.

2. The card connector according to claim 1, wherein said metal cover is connected to a ground and said flexible section of said ground terminal is flexible in said vertically upper region.

3. The card connector according to claim 1, wherein said ground tongue extends forwardly into said vertically upper region.

4. The card connector according to claim 1, wherein said ground tongue extends rearwardly into said vertically upper region.

5. The card connector according to claim 3, wherein said flexible section of said ground terminal extends rearwardly into said vertically upper region.

6. The card connector according to claim 4, wherein said flexible section of said ground terminal extends forwardly into said vertically upper region.

7. The card connector according to claim 1, which further comprises a card regulation member extending into said card housing space in said vertically upper region.

8. A card connector, comprising:

an insulating housing;

at least one signal terminal provided in said insulating housing;

at least one ground terminal provided in said insulating housing;

a metal cover for covering said insulating housing to form a card housing space for receiving a flat card having at least one signal contact section and at least one ground contact section on at least one surface thereof such that when said flat card is inserted into said card housing space, said signal and ground contact sections are brought into contact with said signal and ground terminals;

said ground terminal having a flexible section disposed in a vertically upper region of said ground contact section when said flat card is in said card housing space;

said metal cover having a ground tongue overlapping said flexible section in said vertically upper region so that when said flat card is inserted into said card housing space, said ground contact section of said flat card comes into contact with and flexes said flexible section of said ground terminal, thus bringing the ground terminal into contact with said ground tongue of said metal cover.

9. The card connector according to claim 8, wherein said metal cover is connected to a ground and said flexible section of said ground terminal is flexible in said vertically upper region.

10. The card connector according to claim 8, wherein said ground tongue extends forwardly into said vertically upper region.

11. The card connector according to claim 8, wherein said ground tongue extends rearwardly into said vertically upper region.

12. The card connector according to claim 10, wherein said flexible section of said ground terminal extends rearwardly into said vertically upper region.

13. The card connector according to claim 11, wherein said flexible section of said ground terminal extends forwardly into said vertically upper region.

14. The card connector according to claim 8, which further comprises a card regulation member extending into said card housing space in said vertically upper region.

* * * * *